US011223115B2

(12) United States Patent
Hashiguchi

(10) Patent No.: US 11,223,115 B2
(45) Date of Patent: Jan. 11, 2022

(54) ANTENNA

(71) Applicant: JAPAN AVIATION ELECTRONICS INDUSTRY, LIMITED, Tokyo (JP)

(72) Inventor: Osamu Hashiguchi, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 85 days.

(21) Appl. No.: 16/736,909

(22) Filed: Jan. 8, 2020

(65) Prior Publication Data

US 2020/0287276 A1 Sep. 10, 2020

(30) Foreign Application Priority Data

Mar. 5, 2019 (JP) ..... JP2019-039447

(51) Int. Cl.
*H01Q 1/36* (2006.01)
*H01Q 1/50* (2006.01)

(52) U.S. Cl.
CPC ..... *H01Q 1/36* (2013.01); *H01Q 1/50* (2013.01)

(58) Field of Classification Search
USPC ..... 343/906
See application file for complete search history.

(56) References Cited

U.S. PATENT DOCUMENTS 5,091,731 A 2/1992 Rees
6,950,068 B2 9/2005 Bordi et al.
7,518,567 B2 4/2009 Utagawa et al.
7,525,711 B1 4/2009 Rule et al.
8,587,494 B2 11/2013 Lee et al.
9,018,110 B2 4/2015 Stowell et al.
9,306,288 B2 4/2016 Park et al.
9,484,631 B1 * 11/2016 Napoles ..... H01Q 5/371
9,502,761 B2 11/2016 Itoh et al.
9,806,418 B2 10/2017 Lin
(Continued)

FOREIGN PATENT DOCUMENTS

CN 1258833 C 6/2006
CN 101981754 A 2/2011
(Continued)

OTHER PUBLICATIONS

Extended European Search Report (EESR) dated Jun. 12, 2020 issued in European Application No. 20150934.6.
(Continued)

*Primary Examiner* — Peguy Jean Pierre
(74) *Attorney, Agent, or Firm* — Holtz, Holtz & Volek PC

(57) ABSTRACT

A main portion of an antenna has a ring-shape with a split and has a first end portion and a second end portion which form the split. A facing portion has a first facing portion provided on the first end portion and a second facing portion provided on the second end portion. The first facing portion and the second facing portion are arranged apart from each other and face each other. A first feeding terminal, a second feeding terminal and an additional terminal are provided on the main portion and used to be fixed to an object when the antenna is mounted on the object. On the main portion, the first feeding terminal is situated nearer to the first end portion than the second feeding terminal is situated, and the additional terminal is situated nearer to the second end portion than the second feeding terminal is situated.

8 Claims, 8 Drawing Sheets

(56) References Cited

U.S. PATENT DOCUMENTS

| | | | | |
|---|---|---|---|---|
| 10,389,161 | B2 * | 8/2019 | Hosseini | H02J 50/00 |
| 2006/0001575 | A1 | 1/2006 | Jo et al. | |
| 2014/0167525 | A1 | 6/2014 | Van Goor et al. | |
| 2014/0203987 | A1 * | 7/2014 | Itoh | H01Q 7/00 343/793 |
| 2016/0294048 | A1 | 10/2016 | Xu et al. | |
| 2017/0301997 | A1 | 10/2017 | Kosaka | |
| 2019/0372227 | A1 * | 12/2019 | Kishimoto | H01Q 7/00 |

FOREIGN PATENT DOCUMENTS

| | | | |
|---|---|---|---|
| CN | 102891352 | A | 1/2013 |
| CN | 103733533 | A | 4/2014 |
| CN | 105024150 | A | 11/2015 |
| CN | 103460353 | B | 8/2016 |
| CN | 109346824 | A | 2/2019 |
| JP | 2007221774 | A | 8/2007 |
| JP | 2016225956 | A | 12/2016 |
| JP | 2018174585 | A | 11/2018 |
| TW | 201628256 | A | 8/2016 |

OTHER PUBLICATIONS

Korean Office Action (and English language translation thereof) dated Oct. 30, 2020 issued in Korean Application No. 10-2020-0005207.

Taiwanese Office Action (and English language translation thereof) dated Sep. 29, 2020 issued in Taiwanese Application No. 109100031.

Chinese Office Action (and English translation thereof) dated Apr. 26, 2021, issued in counterpart Chinese Application No. 202010053176.9.

Extended European Search Report (EESR) dated Apr. 20, 2021, issued in European Application No. 20150934.6.

* cited by examiner

ANTENNA

CROSS REFERENCE TO RELATED APPLICATIONS

This application is based on and claims priority under 35 U.S.C. § 119 to Japanese Patent Application No. JP2019-039447 filed Mar. 5, 2019, the contents of which are incorporated herein in their entireties by reference.

BACKGROUND OF THE INVENTION

This invention relates to an antenna to be mounted on an object and, in particular, to an antenna having a split-ring resonator structure.

JP 2016-225956 A (Patent Document 1) discloses an antenna having a split-ring resonator structure. As shown in FIG. 15, the antenna 90 of Patent Document 1 has a dielectric layer 910, a conductive layer 920 formed on one of a pair of main surfaces of the dielectric layer 910, a feed line 930 formed on the other of the main surfaces of the dielectric layer 910. The conductive layer 920 is formed in a C-shape. In addition, both end portions of the conductive layer 920 are arranged apart from each other and face each other to form a capacitor 940. The conductive layer 920 and the feed line 930 are connected to each other with a via 950 piercing the dielectric layer 910. In detail, the via 950 connects an end portion of the feed line 930 to a vicinity of one of the end portions of the conductive layer 920.

The antenna of Patent Document 1 is fabricated by the use of a printed circuit board. If the antenna fabricated by the use of the printed circuit board does not have desired characteristics owing to fabrication variations, it is necessary to retrofit a matching circuit, such as an inductor, a capacitor or the like, to the antenna, or to remake the printed circuit board. Accordingly, the antenna of Patent Document 1 has a problem that a cost thereof tends to become grater.

SUMMARY OF THE INVENTION

Therefore, it is an object of the present invention to provide an antenna which can be fabricated at a low cost and obtain stable characteristics.

The problem of the antenna of Patent Document 1 may be reduced by producing an antenna as a discrete part. In that case, however, there is a possibility that, during a reflow process executed to mount the antenna on an object such as a substrate, antenna characteristics are changed owing to a difference in coefficient of linear expansion between the antenna and the object.

In view of the forgoing, the present invention provides an antenna to be mounted on an object, which is as follows.

One aspect of the present invention provides an antenna mountable on an object. The antenna comprises a main portion, a facing portion, a first feeding terminal, a second feeding terminal and an additional terminal. The main portion has a ring-shape with a split and has a first end portion and a second end portion which form the split. The facing portion has a first facing portion provided on the first end portion and a second facing portion provided on the second end portion. The first facing portion and the second facing portion arranged apart from each other and face each other. The first feeding terminal, the second feed terminal and the additional terminal are provided on the main portion and are parts which are fixed to the object when the antenna is mounted on the object. The first feeding terminal is situated nearer to the first end portion on the main portion than the second feeding terminal is situated. The additional terminal is situated nearer to the second end portion on the main portion than the second feeding terminal is situated.

In the antenna of one aspect of the present invention, the first feeding terminal is situated nearer to the first end portion than the second feeding terminal is situated, and the additional terminal is situated nearer to the second end portion than the second feeding terminal is situated. In other words, the first feeding terminal is situated near to the first facing portion provided on the first end portion, and the additional terminal is situated near to the second facing portion provided on the second end portion. With this structure, a relative positional relationship between the first facing portion and the second facing portion can be maintained when the antenna is mounted on the object. Thus, the antenna having stable characteristics can be provided.

An appreciation of the objectives of the present invention and a more complete understanding of its structure may be had by studying the following description of the preferred embodiment and by referring to the accompanying drawings.

Figure 1:
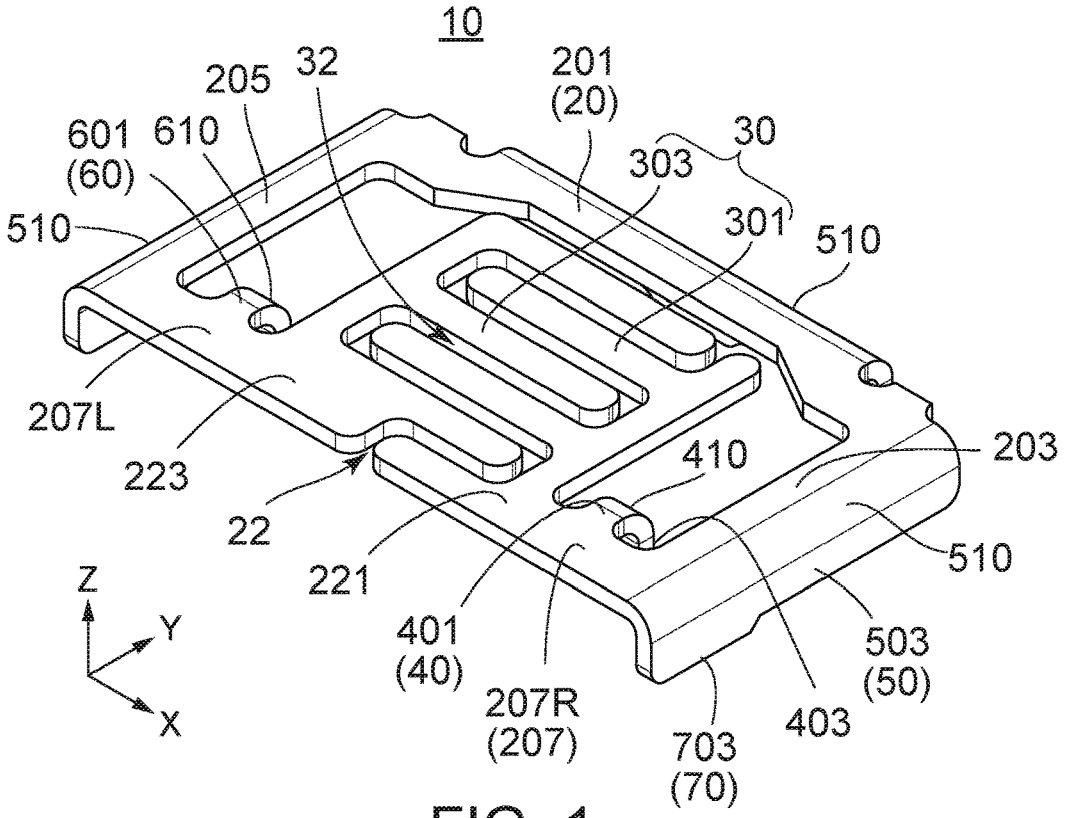
FIG. 1 is a top, perspective view showing an antenna according to a first embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

Figure 2:
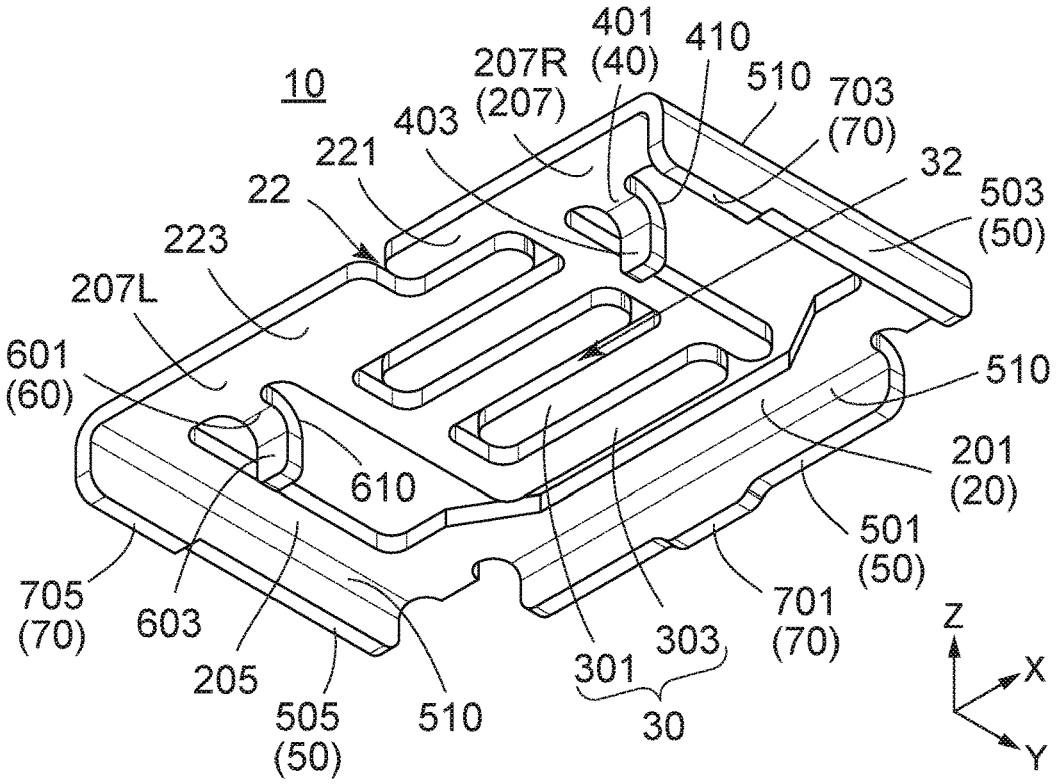
FIG. 2 is a bottom, perspective view showing the antenna of FIG. 1.

Referring to FIGS. 1 and 2, an antenna 10 according to a first embodiment of the present invention has a split-ring resonator structure. In detail, the antenna 10 is provided with a main portion 20, a facing portion 30, a first feeding terminal 40, three second feeding terminals 50 (501, 503, 505), an additional terminal 60 and three fixed portions 70 (701, 703, 705). As understood from FIGS. 1 and 2, in the present embodiment, the antenna 10 is a single-piece member which is formed by punching a single metal sheet and bending the punched metal sheet.

Figure 3:
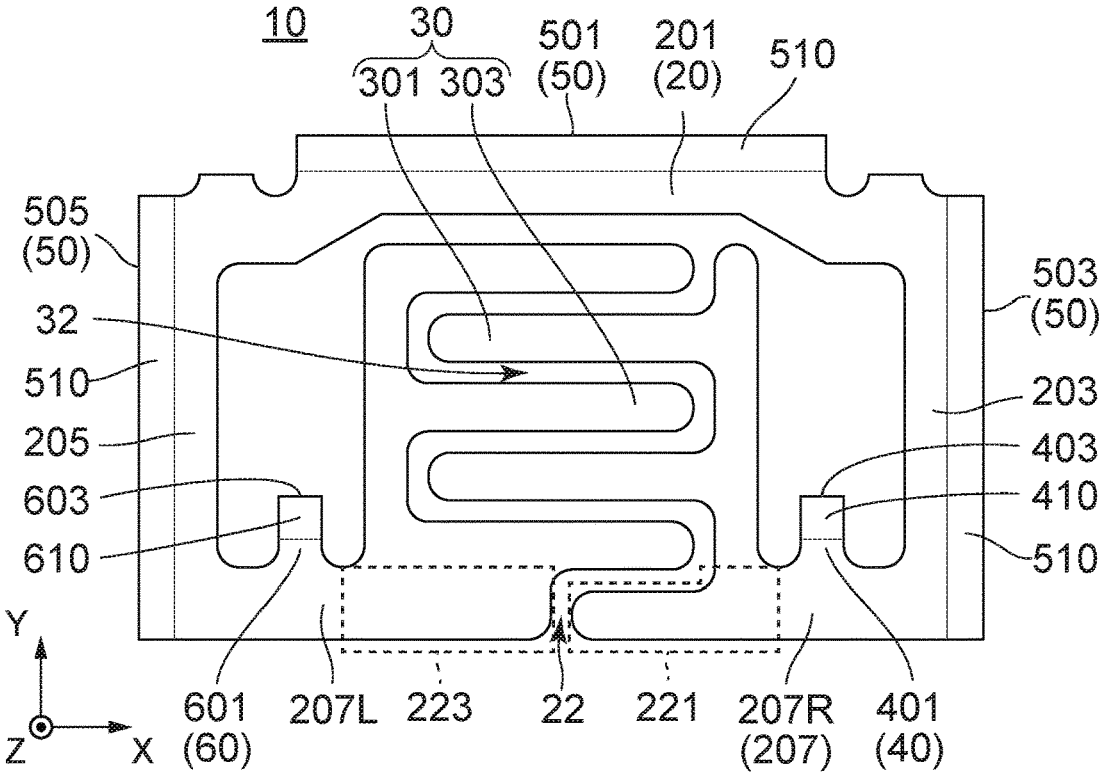
FIG. 3 is a top view showing the antenna of FIG. 1.
Figure 4:
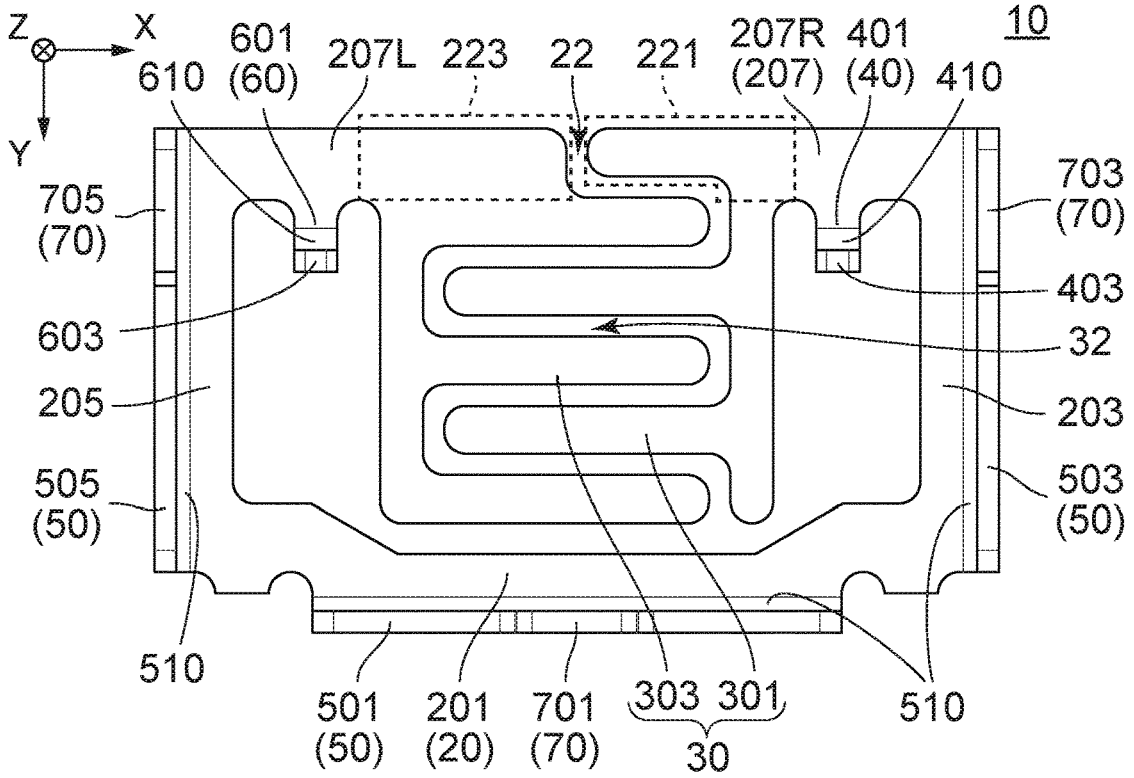
FIG. 4 is a bottom view showing the antenna of FIG. 1.
Figure 5:
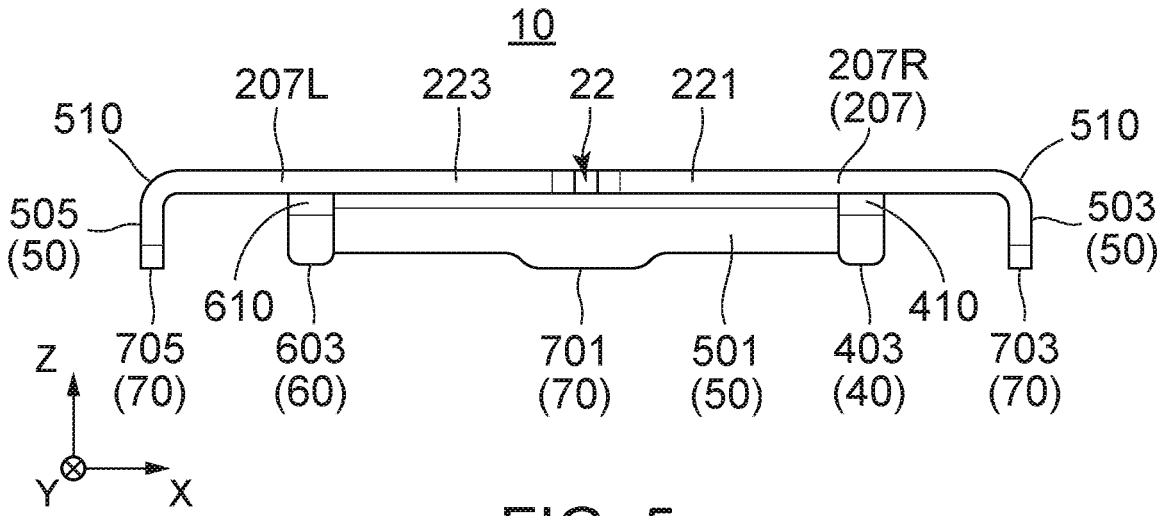
FIG. 5 is a front view showing the antenna of FIG. 1.
Figure 6:
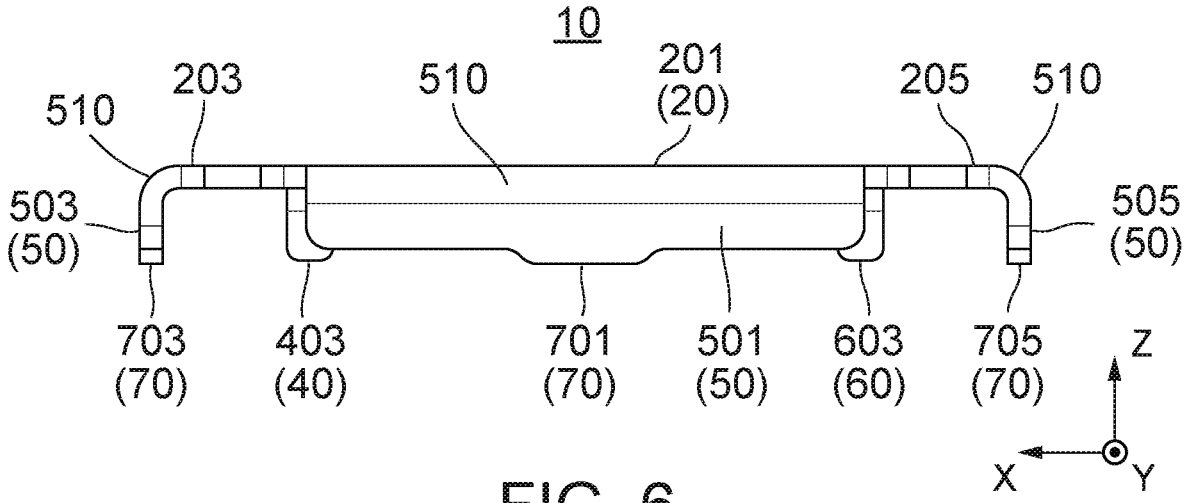
FIG. 6 is a rear view showing the antenna of FIG. 1.
Figure 7:
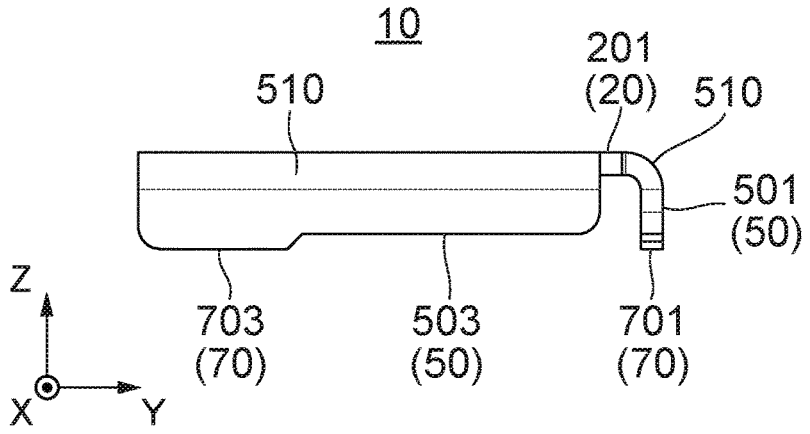
FIG. 7 is a right-side view showing the antenna of FIG. 1.

Referring to FIGS. 3 and 4, the main portion 20 has a ring-shape with a split 22. Here, the "ring-shape" is not limited to a circular-shape but includes other shapes such as an oval-shape, a polygonal-shape and so on. In the present embodiment, the main portion 20 has an approximately rectangular-shape with four sides. Moreover, the main portion 20 has a first end portion 221 and a second end portion 223 which form the split 22. In detail, the main portion 20 is provided with a first side portion 201 extending in a lateral direction, a second side portion 203 and a third side portion 205 which extend forward from both ends of the first side portion 201, respectively, and a fourth side portion 207 located between a front end portion of the second side portion 203 and a front end portion of the third side portion 205. In the present embodiment, the lateral direction is an X-direction. A front-rear direction is a Y-direction. A negative Y-direction is directed forward while a positive Y-direction is directed rearward.

As shown in FIGS. 3 and 4, the split 22 is formed at the middle of the fourth side portion 207 in the lateral direction. In other words, the fourth side portion 207 is divided in two portions, a fourth side right part 207R and a fourth side left part 207L, by the split 22. The first end portion 221 of the main portion 20 is one of end portions of the fourth side right part 207R while the second end portion 223 is one of end portions of the fourth side left part 207L.

As shown in FIGS. 1 to 4, the facing portion 30 is situated between the first side portion 201 of the main portion 20 and the fourth side portion 207 of the main portion 20 in the front-rear direction. Moreover, the facing portion 30 is situated between the second side portion 203 of the main portion 20 and the third side portion 205 of the main portion 20 in the lateral direction. In addition, the facing portion 30 is flush with the main portion 20. The facing portion 30 is provided on specific one of the sides of the main portion 20. In more detail, the facing portion 30 is provided on a middle portion of the fourth side portion 207 of the main portion 20. That is, the specific one of the sides is the fourth side portion 207 in the present embodiment. However, the present invention is not limited thereto. The facing portion 30 may be provided so that a distance from the facing portion 30 to the second side portion 203 is shorter or longer than a distance from the facing portion 30 to the third side portion 205. In that modification, the split 22 of the main portion 20 would be situated near to one of the second side portion 203 and the third side portion 205.

As shown in FIGS. 3 and 4, the facing portion 30 is situated between the first side portion 201 of the main portion 20 and the fourth side portion 207 of the main portion 20 in the front-rear direction. Moreover, the facing portion 30 is situated between the second side portion 203 of the main portion 20 and the third side portion 205 of the main portion 20 in the lateral direction. In detail, the facing portion 30 has a first facing portion 301 and a second facing portion 303. Then, the first facing portion 301 and the second facing portion 303 are provided on the first end portion 221 of the main portion 20 and the second end portion 223 of the main portion 20, respectively. The first facing portion 301 and the second facing portion 303 extend rearward from the first end portion 221 and the second end portion 223, respectively. The first facing portion 301 and the second facing portion 303 are apart from the first side portion 201 of the main portion 20, the second side portion 203 of the main portion 20 and the third side portion 205 of the main portion 20.

As shown in FIGS. 3 and 4, the first facing portion 301 and the second facing portion 303 are arranged apart from each other and face each other. In detail, each of the first facing portion 301 and the second facing portion 303 has a comb-shape. The first facing portion 301 and the second facing portion 303 are arranged with a space left therebetween so that tooth of the first facing portion 301 and tooth of the second facing portion 303 are alternately arranged in the front-rear direction. In other words, the first facing portion 301 and the second facing portion 303 form an interdigital portion 30, and an interdigital slot 32 is made between the first facing portion 301 and the second facing portion 303. Thus, the first facing portion 301 and the second facing portion 303 form a capacitor. In the present embodiment, the first end portion 221 of the main portion 20 and the second end portion 223 of the main portion 20 also form a part of the interdigital portion 30. On the other hand, the main portion 20 forms an inductor and constitutes an LC resonant circuit in conjunction with the facing portion 30.

As shown in FIGS. 1 to 4, the first feeding terminal 40 is provided on the main portion 20. On the main portion 20, the first feeding terminal 40 of the present embodiment is provided nearer to the first end portion 221 than any of the second feeding terminals 50 is provided. In other words, the first feeding terminal 40 is situated between any of the second feeding terminals 50 and the first end portion 221 on the main portion 20. In detail, the first feeding terminal 40 is provided on the main portion 20 so that a current path between the first feeding terminal 40 and the first end portion 221 is shorter than a current path between the first feeding terminal 40 and each of the second feeding terminals 50.

As shown in FIGS. 1 to 4, the first feeding terminal 40 is provided on the fourth side right part 207R of the main portion 20. The first feeding terminal 40 is situated near to the first end portion 221 but away from the first end portion 221 and the first facing portion 301. In addition, a shortest distance between the first feeding terminal 40 and the first facing portion 301 is shorter than a shortest distance between the first feeding terminal 40 and the second feeding terminal 503.

As shown in FIGS. 2 to 4, the first feeding terminal 40 has a first part 401 extending from an inside edge of the fourth side right part 207R of the main portion 20 in an inward direction of the main portion 20 and a second part 403 extending from an end of the first part 401 in an intersecting direction intersecting the inward direction via a bent part 410. In the present embodiment, the intersecting direction is directed downward. An up-down direction is a Z-direction in the present embodiment. A positive Z-direction is directed upward while a negative Z-direction is directed downward.

As understood from FIGS. 1 to 4, the additional terminal 60 is situated opposite to the first feeding terminal 40 across the facing portion 30. In the present embodiment, an arrangement of the additional terminal 60 and the first feeding terminal 40 is symmetrical with respect to the facing portion 30. In other words, the additional terminal 60 is situated between any of the second feeding terminals 50 and the second end portion 223 on the main portion 20. In detail, the arrangement of the additional terminal 60 and the first feeding terminal 40 is surface-symmetrical with respect to a plane (hereinafter referred to as a reference plane) perpendicular to the lateral direction and passing through the middle, in the lateral direction, of the facing portion 30.

However, the present invention is not limited thereto. The arrangement of the additional terminal 60 and the first feeding terminal 40 may not be symmetrical.

As shown in FIGS. 1 to 4, the additional terminal 60 is provided on the fourth side left part 207L of the main portion 20 in the present embodiment. The additional terminal 60 is provided, on the main portion 20, nearer to the second end portion 223 than any one of the second feeding terminals 50 is provided. Moreover, the additional terminal 60 is situated near to the second end portion 223 but away from the second end portion 223 and the second facing portion 303. In addition, a shortest distance between the additional terminal 60 and the second facing portion 303 is shorter than a shortest distance between the additional terminal 60 and the second feeding terminal 505.

As shown in FIGS. 2 to 4, the additional terminal 60 is formed similarly to the first feeding terminal 40. In detail, the additional terminal 60 has a first part 601 extending from an inside edge of the fourth side left part 207L of the main portion 20 in the inward direction of the main portion 20 and a second part 603 extending from an end of the first part 601 in the intersecting direction intersecting the inward direction via a bent part 610. In the present embodiment, the second part 603 of the additional terminal 60 extends downward. However, the present invention is not limited thereto. The additional terminal 60 may have a different shape and a different size which are different from those of the first feeding terminal 40. Changing one or more of the position, the shape and the size of the additional terminal 60 allows a resonance frequency of the antenna 10 to be varied. However, it is easy to design the antenna 10 in a case where the first feeding terminal 40 and the additional terminal 60 have the same shape and the same size and are arranged on symmetric positions when compared with other cases.

As shown in FIG. 2 and FIGS. 4 to 7, each of the second feeding terminals 501, 503 and 505 is provided on the main portion 20 via a bent part 510. In detail, the second feeding terminals 501, 503 and 505 are provided on the first side portion 201 of the main portion 20, the second side portion 203 of the main portion 20 and the third side portion 205 of the main portion 20, respectively, via the bent parts 510. The second feeding terminal 501 has a rectangular plate-shape long in the lateral direction and extends downward. Each of the second feeding terminals 503 and 505 has a rectangular plate-shape long in the front-rear direction and extends downward.

As shown in FIG. 4, the second feeding terminals 50 are arranged to be mirror images of each other with respect to the facing portion 30. In other words, the arrangement of the second feeding terminals 50 is symmetrical with respect to the facing portion 30. However, the present invention is not limited thereto. The second feeding terminals 50 may be arranged not to be mirror images of each other with respect to the facing portion 30. Moreover, one of the second feeding terminals 50 is essential, and the remains are optional.

As shown in FIG. 2 and FIGS. 4 to 7, the fixed portions 701, 703 and 705 correspond to the second feeding terminals 501, 503 and 505, respectively. In the present embodiment, the number of the fixed portions 70 is equal to the number of the second feeding terminals 50. However, each of the second feeding terminals 501, 503 and 505 may be provided with a plurality of the fixed portions 70.

As understood from FIG. 2 and FIGS. 4 to 7, the fixed portions 701, 703 and 705 are integrally formed with the second feeding terminals 501, 503 and 505, respectively. The fixed portions 701, 703 and 705 extend downward from lower edges of the second feeding terminals 501, 503 and 505, respectively. The fixed portions 701, 703 and 705 can be considered as parts of the second feeding terminals 501, 503 and 505. In the up-down direction, positions of lower edges of the fixed portions 701, 703 and 705 approximately coincide with a position of a lower edge of the first feeding terminal 40 and a position of a lower edge of the additional terminal 60.

As understood from FIG. 4, in the present embodiment, the fixed portions 70 are arranged to be mirror images of each other with respect to the facing portion 30. The arrangement of the fixed portions 70 is symmetrical with respect to the facing portion 30. In detail, the arrangement of the fixed portions 70 is surface-symmetrical with respect to the reference plane. In more detail, the fixed portion 701 has a shape long in the lateral direction and is provided at the middle of the second feeding terminal 501 in the lateral direction. Moreover, the fixed portion 703 and the fixed portion 705 have shapes long in the front-rear direction and are provided on a front end portion of the second side portion 203 and a front end portion of the third side portion 205, respectively. However, the present invention is not limited thereto. The arrangement of the fixed portions 70 may be asymmetrical with respect to the facing portion 30. However, symmetrical arrangement of the fixed portions 70 causes uniform deformation of the antenna 10 upon a reflow process, and thereby change of characteristics of the antenna 10 can be suppressed. In addition, when the antenna 10 receives an external force unexpected, the symmetrical arrangement of the fixed portions 70 can disperse the external force appropriately to prevent or restrain deformation of the antenna 10.

The antenna 10 (see FIGS. 1 and 2) according to the present embodiment is mounted on an object (not shown). The object is a printed circuit board, for example. The object has an antenna mount surface (not shown), and a plurality of connection pads (not shown) are formed on the antenna mount surface. In addition, the object is provided with a feed line (not shown) to be connected to the first feeding terminal 40 of the antenna 10 and a ground plane (not shown) to be connected to the second feeding terminals 50.

When the antenna 10 (see FIGS. 1 and 2) is mounted on the object, each of the second part 403 of the first feeding terminal 40, the second part 603 of the additional terminal 60 and the fixed portions 70 is fixed on the connection pad (not shown) corresponding thereto. The first feeding terminal 40 is electrically connected to the feed line (not shown) via the connection pad corresponding thereto. Moreover, the second feeding terminals 50 are electrically connected to the ground plane (not shown) via the fixed portions 70 and the connection pads corresponding thereto. With this structure, feeding can be carried out between the first feeding terminal 40 and the second feeding terminals 50. On the other hand, the additional terminal 60 is connected to neither the feed line nor the ground plane in the present embodiment.

According to the present embodiment, as understood from FIGS. 3 and 4, the first feeding terminal 40 is provided nearer to the first facing portion 301, and the additional terminal 60 is provided nearer to the second facing portion 303. In addition, both of the first feeding terminal 40 and the additional terminal 60 are fixed to the object (not shown). With this structure, the fourth side right part 207R and the fourth side left part 207L can be equalized in mechanical strength. In other words, in the reflow process in which the antenna 10 is mounted on the object, an influence on the fourth side right part 207R and the first facing portion 301 can be balanced with an influence on the fourth side left part 207L and the second facing portion 303. As a result, a design of the antenna 10 can be carried out in consideration of change of relative positions of the first facing portion 301 and the second facing portion 303 that is caused by the reflow process so that the antenna 10 having stable characteristics can be obtained.

Second Embodiment

Figure 8:
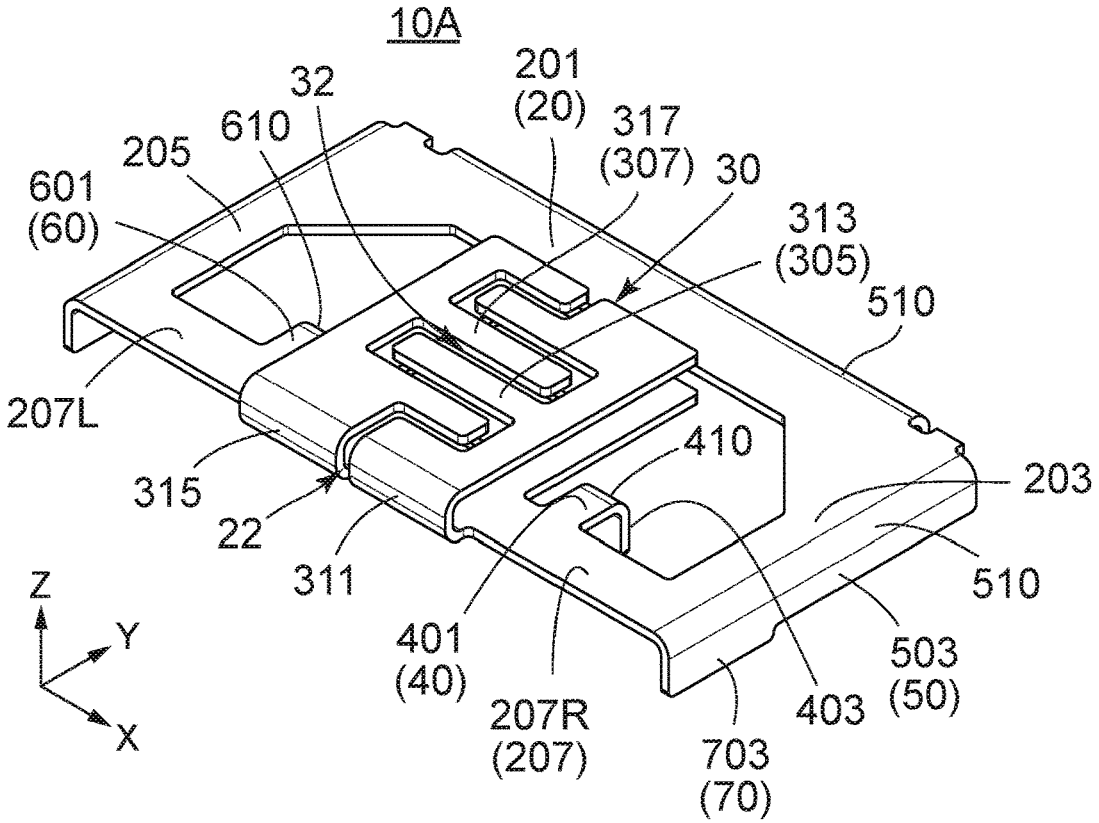
FIG. 8 is a top, perspective view showing an antenna according to a second embodiment of the present invention.
Figure 9:
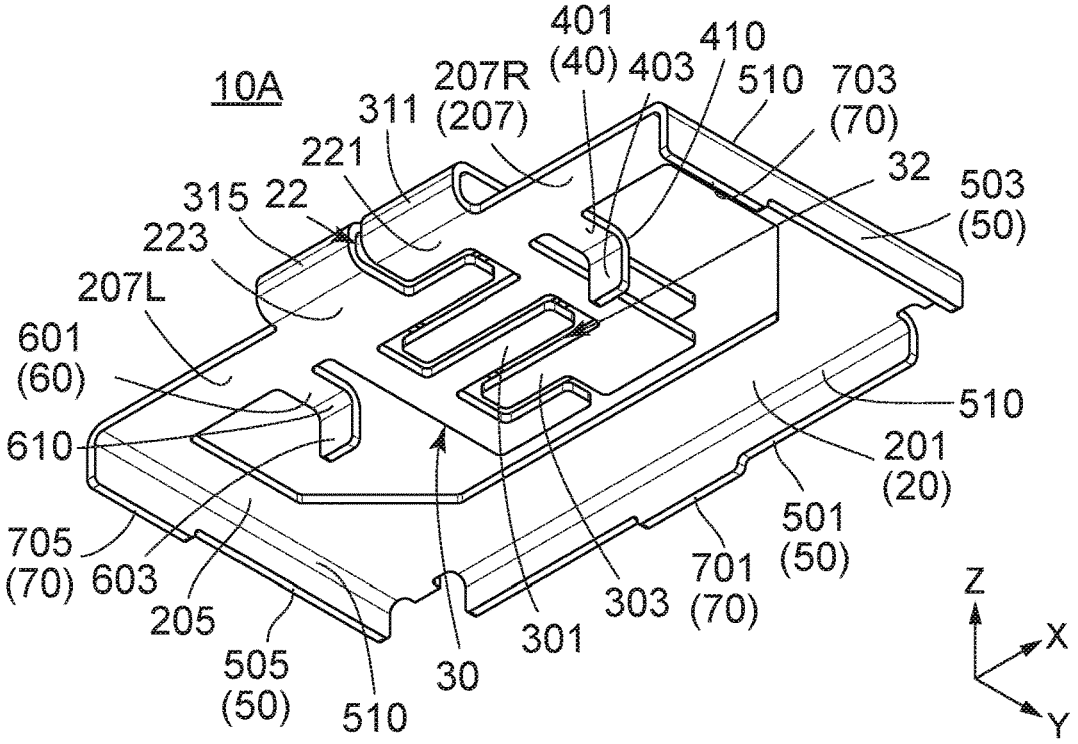
FIG. 9 is a bottom, perspective view showing the antenna of FIG. 8.

Referring to FIGS. 8 and 9, an antenna 10A according to the present embodiment is provided with a third facing portion 305 and a fourth facing portion 307 in addition to the same structure as the antenna 10 according to the first embodiment. In the following description, the same reference numerals are used for the same or corresponding components as the first embodiment.

As shown in FIGS. 8 to 11, the third facing portion 305 has a first connection portion 311 and a first comb portion 313. Moreover, the third facing portion 305 has a second connection portion 315 and a second comb portion 317.

Figure 14:
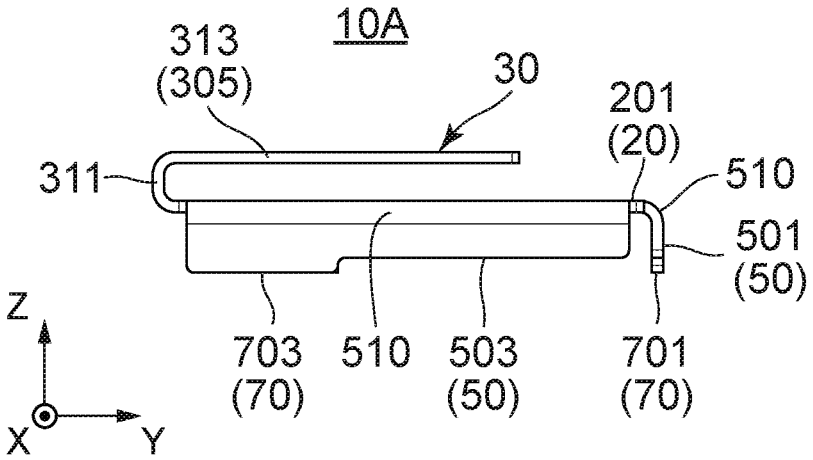
FIG. 14 is a right-side view showing the antenna of FIG. 8.
Figure 15:
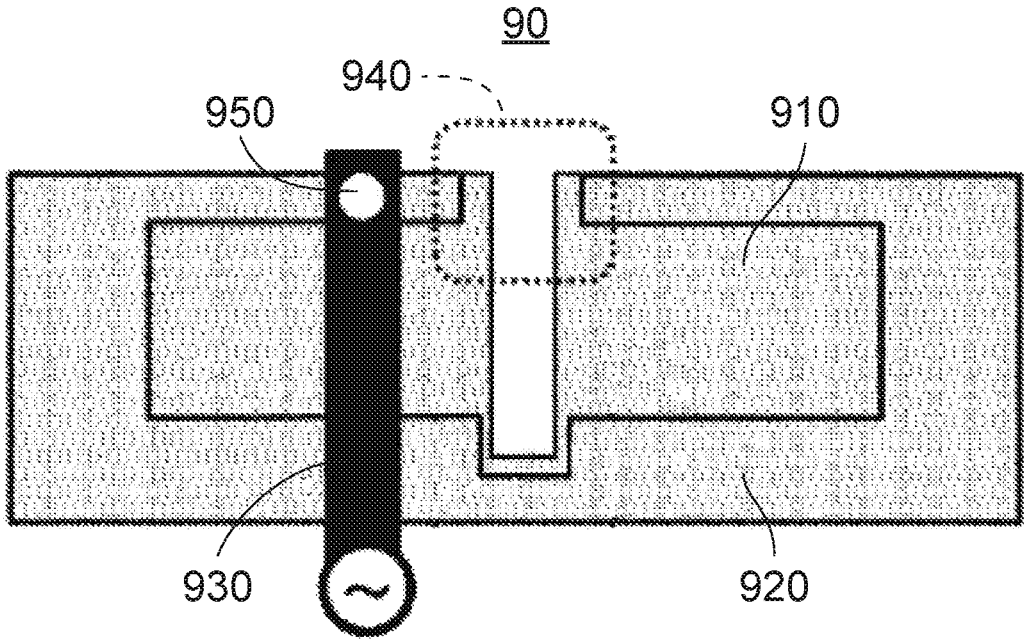
FIG. 15 PRIOR ART
FIG. 15 is a top view showing an antenna disclosed in Patent Document 1. A dielectric layer is hatched. A conductive layer, which is actually hidden by the dielectric layer and invisible, is depicted by a solid line.

As understood from FIGS. 8, 9 and 14, the first connection portion 311 has a C-shape when viewed along the lateral direction. In detail, the first connection portion 311 extends forward from a first end portion 221 of a main portion 20, then extends upward, and further extends rearward. The second connection portion 315 has the same shape as the first connection portion 311. In detail, the second connection portion 315 extends forward from a second end portion 223 of the main portion 20, then extends upward, and further extends rearward. The first comb portion 313 and the second comb portion 317 extend rearward from an end portion of the first connection portion 311 and an end portion of the second connection portion 315, respectively.

Figure 10:
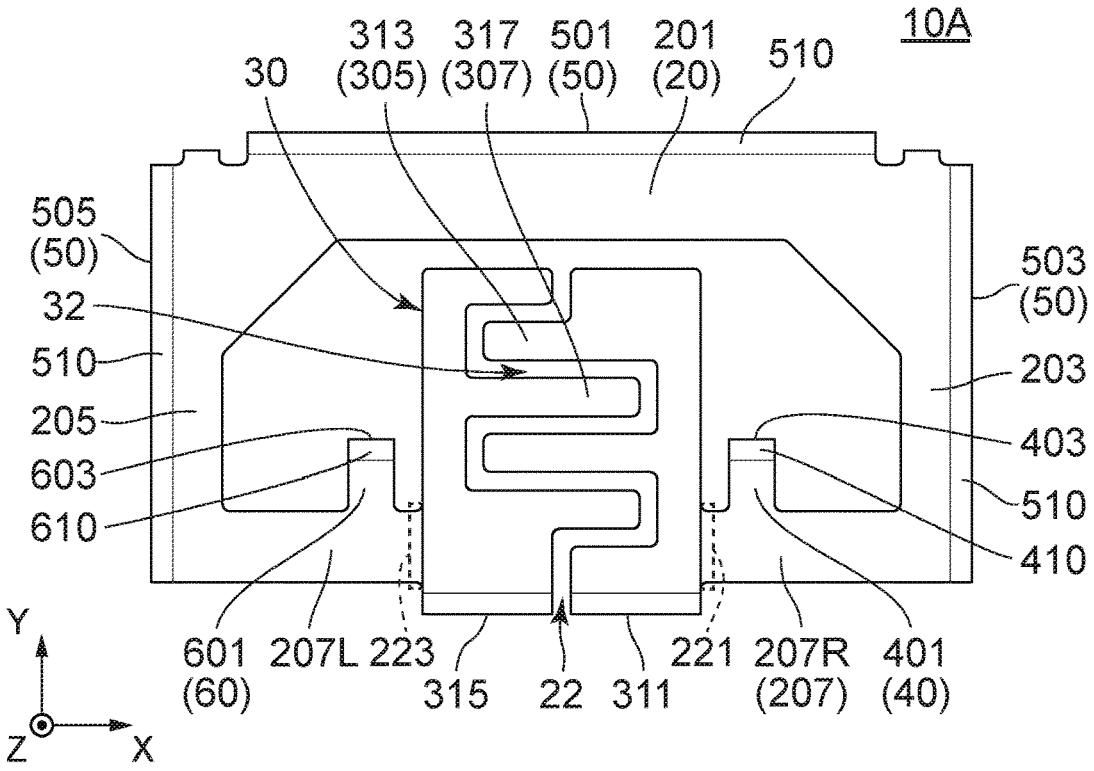
FIG. 10 is a top view showing the antenna of FIG. 8.
Figure 11:
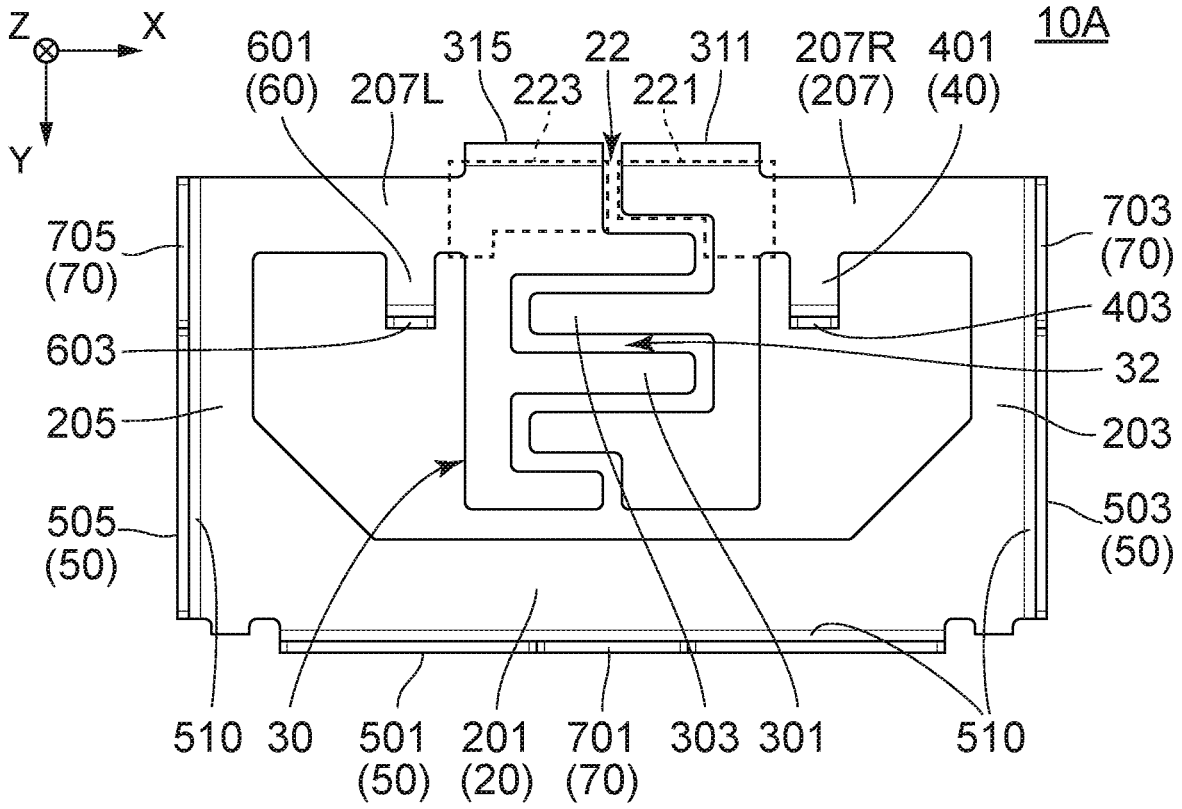
FIG. 11 is a bottom view showing the antenna of FIG. 8.
Figure 12:
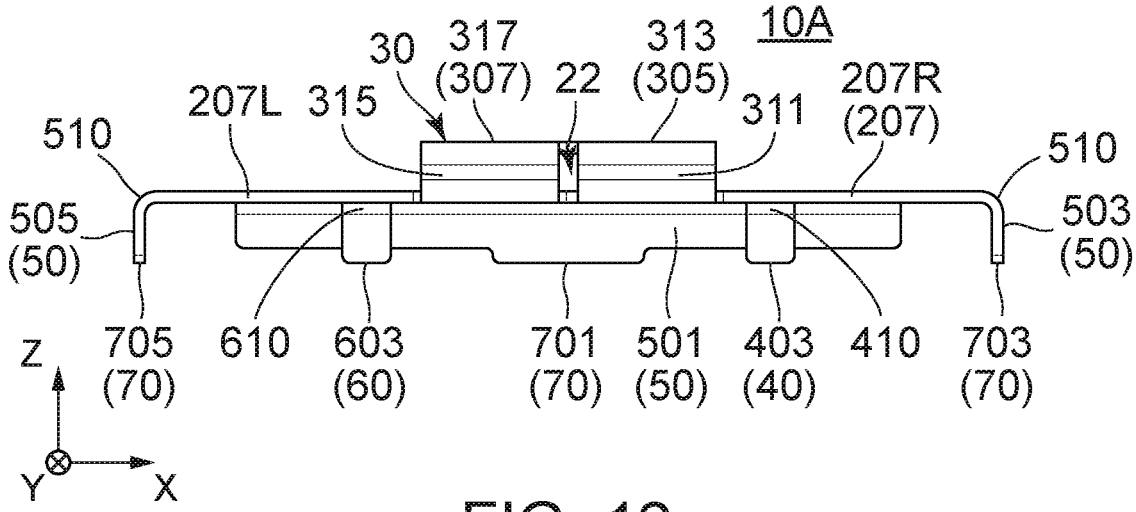
FIG. 12 is a front view showing the antenna of FIG. 8.
Figure 13:
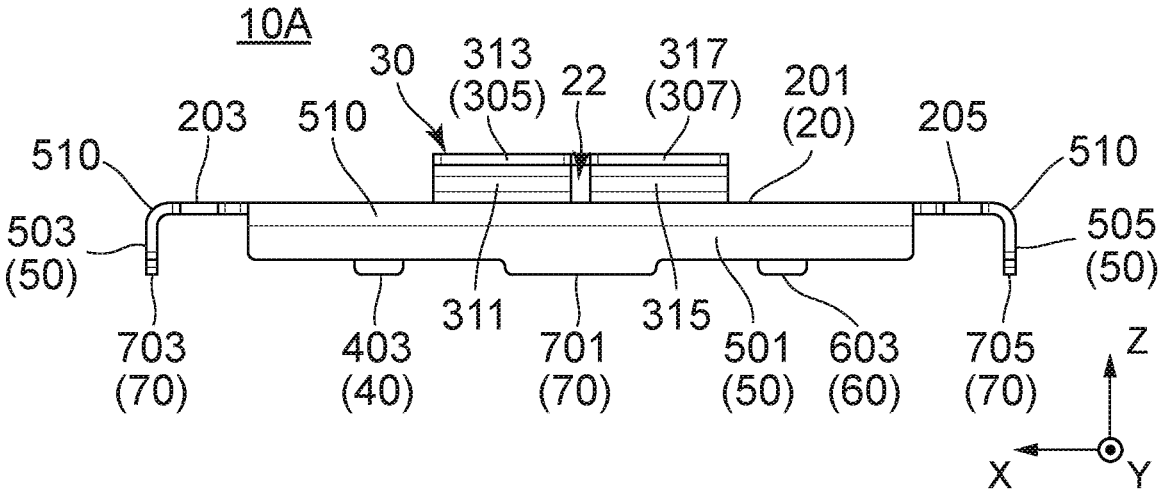
FIG. 13 is a rear view showing the antenna of FIG. 8.

As understood from FIGS. 10 and 11, the first comb portion 313 has the same shape and the same size as a first facing portion 301. Moreover, the second comb portion 317 has the same shape and the same size as a second facing portion 303. As understood from FIGS. 12 to 14, the first comb portion 313 and the second comb portion 317 are flush with each other and arranged in parallel with the first facing portion 301 and the second facing portion 303. Thus, in the present embodiment, a facing portion 30 has a two layer structure.

As understood from FIGS. 8 and 9, the third facing portion 305 and the fourth facing portion 307 form the facing portion (interdigital portion) 30 in conjunction with the first facing portion 301 and the second facing portion 303. With this structure, a capacitance of the capacitor can be increased without increase of a size of the interdigital portion 30 in a plane perpendicular to the up-down direction. Provided that the resonance frequency of the antenna 10A is constant, increase of the capacitance of the capacitor allows an inductance of the main portion 20 to be reduced. This means that a size of the main portion 20 of the antenna 10A can be reduced in the plane perpendicular to the up-down direction. In other words, a footprint of the antenna 10A on an object (not shown) can be reduced.

As shown in FIGS. 8 to 11, also in the antenna 10A according to the present embodiment, an additional terminal 60 is provided opposite to a first feeding terminal 40 across the facing portion 30, similarly to the antenna 10 according to the first embodiment. In detail, the additional terminal 60 is provided to be a mirror image of the first feeding terminal 40 with respect to the facing portion 30. Accordingly, in a reflow process in which the antenna 10A is mounted on the object (not shown), an influence on a fourth side right part 207R, the first facing portion 301 and the third facing portion 305 can be balanced with an influence on the fourth side left part 207L, the second facing portion 303 and the fourth facing portion 307. Thus, according to the present embodiment, each of a relative positional relationship between the first facing portion 301 and the second facing portion 303 and a relative positional relationship between the third facing portion 305 and the fourth facing portion 307 can be maintained, and thereby the antenna 10A having stable characteristics can be obtained.

While there has been described what is believed to be the preferred embodiment of the invention, those skilled in the art will recognize that other and further modifications may be made thereto without departing from the spirit of the invention, and it is intended to claim all such embodiments that fall within the true scope of the invention. For example, although the facing portion 30 has the two layer structure in the second embodiment, the facing portion 30 may have three or more layer structure. In addition, although the third facing portion 305 and the fourth facing portion 307 are arranged above the first facing portion 301 and the second facing portion 303, respectively, in the up-down direction in the second embodiment, the third facing portion 305 and the fourth facing portion 307 may be arranged below the first facing portion 301 and the second facing portion 303, respectively, in the up-down direction.

What is claimed is:

1. An antenna mountable on an object, wherein:

the antenna comprises a main portion, a facing portion, a first feeding terminal, a second feeding terminal, and an additional terminal;

the main portion has a ring-shape with a split and has a first end portion and a second end portion which form the split;

the facing portion has a first facing portion provided on the first end portion and a second facing portion provided on the second end portion;

the first facing portion and the second facing portion are arranged apart from each other and face each other;

the first feeding terminal, the second feed terminal, and the additional terminal are provided on the main portion and are parts which are fixed to the object when the antenna is mounted on the object;

the first feeding terminal is situated nearer to the first end portion on the main portion than the second feeding terminal is situated; and the additional terminal is situated nearer to the second end portion on the main portion than the second feeding terminal is situated.

2. The antenna as recited in claim 1, wherein:

the additional terminal and the second facing portion have a first shortest distance therebetween while the additional terminal and the second feeding terminal have a second shortest distance therebetween; and the first shortest distance is shorter than the second shortest distance.

3. The antenna as recited in claim 1, wherein:

the first feeding terminal is provided apart from the first end portion and the first facing portion; and the additional terminal is provided apart from the second end portion and the second facing portion.

4. The antenna as recited in claim 1, wherein:

each of the first feeding terminal and the additional terminal has a first part extending in an inward direction directed inward of the main portion from the main portion and a second part extending from an end of the first part in an intersecting direction intersecting with the inward direction; and the second part is fixed to the object when the antenna is mounted on the object.

5. The antenna as recited in claim 1, wherein:

the main portion has a substantially rectangular ring-shape having four sides; and the facing portion is provided on one of the four sides.

6. The antenna as recited in claim 5, wherein the first feeding terminal and the additional terminal extend from the one of the four sides.

7. The antenna as recited in claim 1, wherein:

each of the first facing portion and the second facing portion has a comb-shape; and the first facing portion and the second facing portion form an interdigital slot therebetween.

8. The antenna as recited in claim 1, wherein the antenna is made of a single metal sheet having a plurality of bent parts.

* * * * *